US008963447B2

(12) United States Patent
Kumar et al.

(10) Patent No.: US 8,963,447 B2
(45) Date of Patent: Feb. 24, 2015

(54) BALLAST WITH CURRENT CONTROL CIRCUIT

(71) Applicants: Nitin Kumar, Burlington, MA (US); Shashank Bakre, Burlington, MA (US)

(72) Inventors: Nitin Kumar, Burlington, MA (US); Shashank Bakre, Burlington, MA (US)

(73) Assignee: Osram Sylvania Inc., Danvers, MA (US)

( * ) Notice: Subject to any disclaimer, the term of this patent is extended or adjusted under 35 U.S.C. 154(b) by 65 days.

(21) Appl. No.: 13/784,711

(22) Filed: Mar. 4, 2013

(65) Prior Publication Data

US 2014/0246984 A1 Sep. 4, 2014

(51) Int. Cl.
*H05B 37/02* (2006.01)
*H05B 41/36* (2006.01)

(52) U.S. Cl.
CPC ..... *H05B 41/36* (2013.01)
USPC ..... 315/307; 315/224; 315/247

(58) Field of Classification Search
USPC ..... 315/209 R, 224–226, 247, 291, 294, 315/297, 307
See application file for complete search history.

(56) References Cited

U.S. PATENT DOCUMENTS

| | | | | | |
|---|---|---|---|---|---|
| 5,517,086 | A * | 5/1996 | El-Hamamsy et al. | ..... | 315/247 |
| 5,828,187 | A * | 10/1998 | Fischer | ..... | 315/291 |
| 5,872,429 | A * | 2/1999 | Xia et al. | ..... | 315/194 |
| 6,362,575 | B1 * | 3/2002 | Chang et al. | ..... | 315/224 |
| 2006/0017403 | A1 * | 1/2006 | Matsushima | ..... | 315/291 |
| 2009/0033236 | A1 * | 2/2009 | Alexandrov | ..... | 315/224 |

* cited by examiner

*Primary Examiner* — Tung X Le
(74) *Attorney, Agent, or Firm* — Shaun P. Montana

(57) ABSTRACT

A ballast configured to connect to a set of lamps to energize the set of lamps is provided. The ballast comprises an inverter circuit for generating an oscillating power signal, wherein the oscillating power signal has a frequency, and a resonant tank circuit electrically connected to the inverter circuit for receiving the oscillating power signal and therefrom providing a lamp current to the set of lamps. A resistance circuit is connected to the inverter circuit. The resistance circuit has a resistance that defines the frequency of the oscillating power signal generated by the inverter circuit. A current control circuit is connected to the resistance circuit for adjusting the resistance of the resistance circuit as a function of a number of lamps that are connected to the ballast.

20 Claims, 2 Drawing Sheets

BALLAST WITH CURRENT CONTROL CIRCUIT

TECHNICAL FIELD

The present invention relates to lighting, and more specifically, to electronic ballasts for lighting.

BACKGROUND

An electronic ballast is configured to provide a lamp current for energizing a set of lamps. A ballast includes an inverter circuit for generating an oscillating power signal, and the lamp current is produced from the oscillating power signal. Some ballasts are configured to provide a lamp current for energizing a set of lamps that includes a variable number of lamps. For example, a ballast may be configured to provide a lamp current for energizing up to two lamps that are connected together in series. Thus, the ballast energizes two lamps when both lamps are connected to the ballast, and energizes only one lamp when one of the lamps becomes disconnected from the ballast.

In general, such ballasts operate the inverter circuit at the same frequency (i.e., the oscillating power signal has the same frequency) even when the number of lamps has changed. Thus, when one of the two lamps is disconnected from the ballast, the lamp current provided to the remaining lamp increases beyond a nominal value.

SUMMARY

Embodiments of the present invention relate to a ballast that adjusts the lamp current provided to the lamp set based on the number of lamps connected to the ballast. In particular, the ballast adjusts the frequency of the inverter circuit based on the number of lamps connected to the ballast, which in turn adjusts the lamp current provided to the lamp(s) that are connected to the ballast in order to operate them efficiently.

In some embodiments, the ballast is configured to connect to and energize a set of up to a maximum number of lamps. The ballast includes a rectifier for receiving an alternating current (AC) voltage signal and producing a rectified voltage signal therefrom. A power factor correction circuit is electrically connected to the rectifier for receiving the rectified voltage signal and for providing a corrected voltage signal. The inverter circuit is electrically connected to the power factor correction circuit for receiving the corrected voltage signal and generating an oscillating power signal therefrom. A resonant tank circuit is electrically connected to the inverter circuit for receiving the oscillating power signal and therefrom providing a lamp current to the set of lamps. A resistance circuit is connected to the inverter circuit. For example, in some embodiments, the inverter circuit may include a half bridge driver that drives the frequency of the inverter circuit operation, and the resistance circuit is connected to the half bridge driver. The resistance circuit has a resistance that defines the frequency of the oscillating power signal generated by the inverter circuit. In some embodiments, the resistance circuit comprises a first resistive component connected to the inverter circuit and a second resistive component selectively connected to the inverter circuit so that the second resistive component is in parallel with the first resistive component.

A switching circuit is connected to first resistive component and to the second resistive component. The switching circuit is configured to connect the second resistive component to the inverter circuit so that it is in parallel with the first resistive component only when a number of lamps that is less than the maximum number of lamps is connected to the ballast. Thus, when the switching component connects the second resistive component in parallel with the first resistive component, the effective resistance of the resistance circuit is decreased causing an increase in the frequency of the power signal, and in turn, a decrease in the lamp current provided to the lamp set.

In an embodiment, there is provided a ballast. The ballast includes: an inverter circuit configured to generate an oscillating power signal, wherein the oscillating power signal has a frequency; a resonant tank circuit electrically connected to the inverter circuit and configured to receive the oscillating power signal and therefrom to provide a lamp current to a set of lamps connected to the ballast; a resistance circuit connected to the inverter circuit, the resistance circuit having a resistance that defines the frequency of the oscillating power signal generated by the inverter circuit; and a current control circuit connected to the resistance circuit and configured to adjust the resistance of the resistance circuit as a function of a number of lamps that are connected to the ballast.

In a related embodiment, the current control circuit may be configured to decrease the resistance of the resistance circuit when the number of lamps that are connected to the ballast is decreased. In another related embodiment, the resistance circuit may include a first resistive component that is connected to the inverter circuit, and the current control circuit may be configured to selectively connect and disconnect a second resistive component to the inverter circuit as a function of the number of lamps that are connected to the ballast. In still another related embodiment, the resistance circuit may include a first resistive component that is connected to the inverter circuit, and the current control circuit may be configured to connect a second resistive component to the inverter circuit in parallel with the first resistive component when the number of lamps that are connected to the ballast is decreased.

In yet another related embodiment, the inverter circuit may include a high side half bridge driver. In a further related embodiment, the resistance circuit may include a first resistive component that is connected to the high side half bridge driver. In a further related embodiment, the ballast may further include a second resistive component, wherein the current control circuit may include a switching circuit that is connected to the second resistive component to selectively connect the second resistive component in parallel with the first resistive component.

In still yet another related embodiment, the current control circuit may be configured to adjust the resistance of the resistance circuit so that the lamp current provided to the lamp set is decreased when the number of lamps that are connected to the ballast is decreased. In yet still another further related embodiment, the ballast may further include: a rectifier configured to receive an alternating current (AC) voltage signal and to produce a rectified voltage signal therefrom; and a power factor correction circuit electrically connected to the rectifier and configured to receive the rectified voltage signal and to provide a corrected voltage signal, wherein the inverter circuit may be electrically connected to the power factor correction circuit to receive the corrected voltage signal and to generate the oscillating power signal therefrom.

In another embodiment, there is provided a ballast configured to connect to and energize a set of up to a maximum number of lamps. The ballast includes: a rectifier configured to receive an alternating current (AC) voltage signal and to produce a rectified voltage signal therefrom; a power factor correction circuit electrically connected to the rectifier and configured to receive the rectified voltage signal and to provide a corrected voltage signal; an inverter circuit electrically connected to the power factor correction circuit and configured to receive the corrected voltage signal and to generate an oscillating power signal therefrom, wherein the oscillating power signal has a frequency; a resonant tank circuit electrically connected to the inverter circuit and configured to receive the oscillating power signal and therefrom provide a lamp current to a set of lamps; a resistance circuit connected to the inverter circuit, the resistance circuit having a resistance that defines the frequency of the oscillating power signal generated by the inverter circuit, the resistance circuit comprising a first resistive component connected to the inverter circuit and a second resistive component selectively connected to the inverter circuit so that the second resistive component is in parallel with the first resistive component; and a switching circuit configured to connect the second resistive component to the inverter circuit so that it is in parallel with the first resistive component only when a number of lamps in the set of lamps that is less than the maximum number of lamps is connected to the ballast.

In a related embodiment, the maximum number of lamps may be two lamps connected together in series. In another related embodiment, the inverter circuit may include a high side half bridge driver, and the first resistive component may be connected to the high side half bridge driver. In yet another related embodiment, the switching circuit may include a first switch, a second switch, and a third switch, wherein the first switch may be adapted to connect to the set of lamps to detect a threshold voltage indicative of a presence of a lamp, wherein the second switch may be connected to the first switch, and wherein the third switch may be connected to the second switch and to the second resistive component and the first resistive component. In a further related embodiment, the first switch may be configured to operate in an ON state when the threshold voltage is detected and to operate in an OFF state when the threshold voltage is not detected. In another further related embodiment, the second switch may be configured to operate in an OFF state when the first switch operates in an ON state, and the second switch may be configured to operate in an ON state when the first switch operates in an OFF state. In another further related embodiment, the third switch may be configured to operate in an OFF state when the second switch operates in an OFF state, and the third switch may be configured to operate in an ON state when the second switch operates in an ON state.

In another embodiment, there is provided a ballast. The ballast includes: a rectifier configured to receive an alternating current (AC) voltage signal and to produce a rectified voltage signal therefrom; a power factor correction circuit electrically connected to the rectifier and configured to receive the rectified voltage signal and to provide a corrected voltage signal; an inverter circuit electrically connected to the power factor correction circuit and configured to receive the corrected voltage signal and to generate an oscillating power signal therefrom, wherein the oscillating power signal has a frequency; a resonant tank circuit electrically connected to the inverter circuit and configured to receive the oscillating power signal and therefrom provide a lamp current to a set of one or more lamps; a resistance circuit connected to the inverter circuit, the resistance circuit having a resistance that defines the frequency of the oscillating power signal generated by the inverter circuit, the resistance circuit comprising a first resistive component connected to the inverter circuit and a second resistive component selectively connected to the first resistive component; and a switching circuit configured to operate in a first state that connects the second resistive component to the first resistive component when only one lamp is connected to the ballast and to operate in a second state that prohibits a connection between the second resistive component and the first resistive component when more than one lamp is connected to the ballast.

In a related embodiment, the second resistive component may be selectively connected in parallel with the first resistive component. In another related embodiment, the inverter circuit may include a high side half bridge driver, and the first resistive component may be connected to the high side half bridge driver. In still another related embodiment, the switching circuit may include a first switch, a second switch, and a third switch, wherein the first switch may be adapted to connect to the set of lamps to detect a threshold voltage indicative of a presence of a lamp, wherein the second switch may be connected to the first switch, and wherein the third switch may be connected to the second switch and to the second resistive component and the first resistive component.

BRIEF DESCRIPTION OF THE DRAWINGS

The foregoing and other objects, features and advantages disclosed herein will be apparent from the following description of particular embodiments disclosed herein, as illustrated in the accompanying drawings in which like reference characters refer to the same parts throughout the different views. The drawings are not necessarily to scale, emphasis instead being placed upon illustrating the principles disclosed herein.

DETAILED DESCRIPTION

Figure 1:
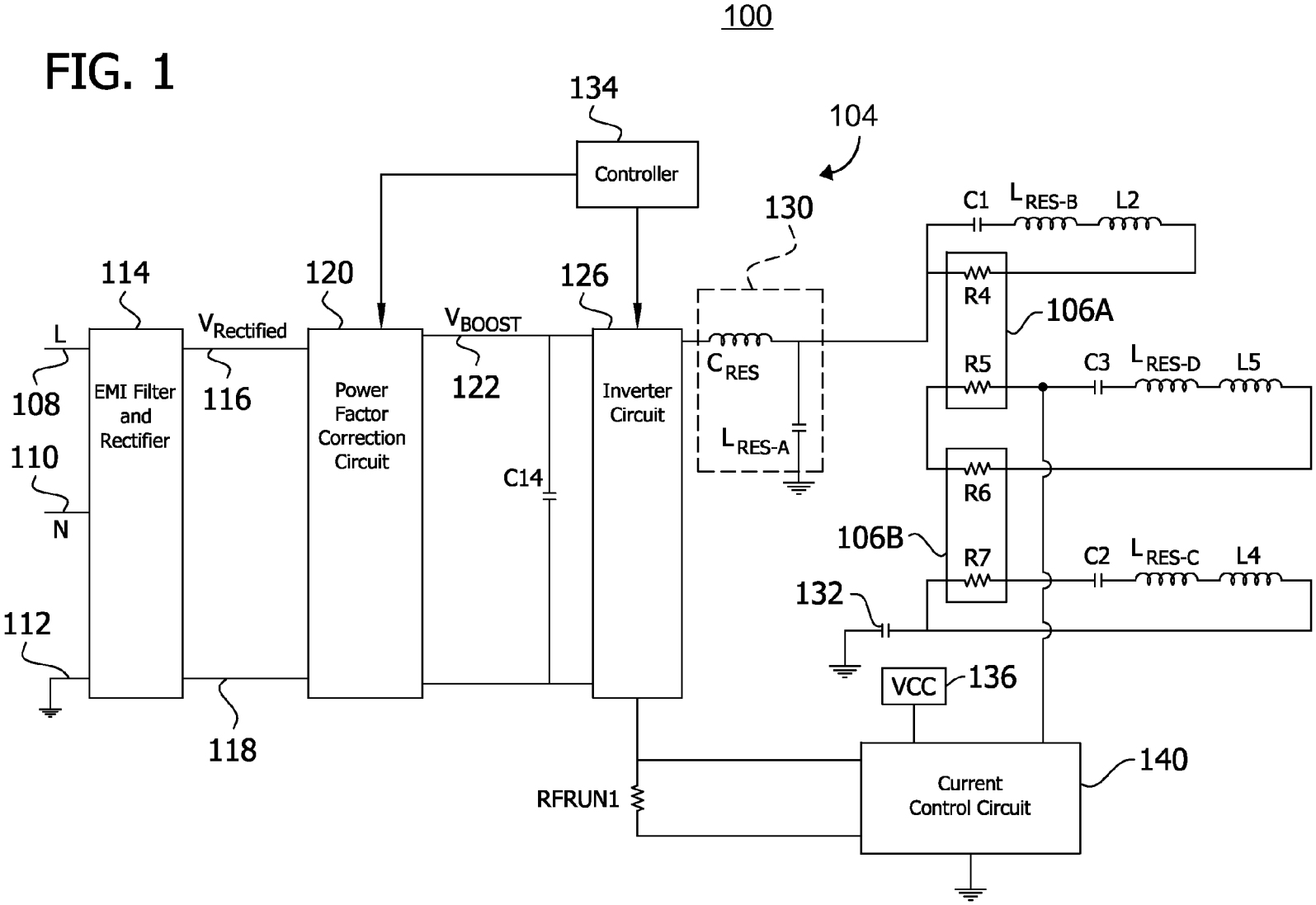
FIG. 1 is a schematic diagram, partially in block form, of a lamp system according to embodiments disclosed herein.

FIG. 1 illustrates a lamp system 100 that includes an input power source (not shown), such as but not limited to an alternating current (AC) power supply, an electronic ballast 104 (also referred to throughout as a ballast 104), and a plurality of lamps 106A, 106B (also referred to throughout as a lamp set 106A, 106B). The electronic ballast 104 may be, and in some embodiments is, any type of electronic ballast known in the art, such as but not limited to an instant start ballast, a rapid start ballast, a programmed start ballast, and the like. In some embodiments, the plurality of lamps 106A, 106B are fluorescent lamps, such as T5, T8, or TT5 fluorescent lamps available from OSRAM SYLVANIA, Phillips, General Electric, and others. However, embodiments contemplate the use of other types of lamps as well. As described below, the illustrated plurality of lamps 106 are connected together in series. However, embodiments may be used with a plurality of lamps 106 that are connected together in parallel as well, or combinations involving series and parallel connections.

The ballast 104 includes at least one high voltage input terminal (i.e., line voltage input terminal) 108 adapted for connecting to the alternating current (AC) power supply (e.g., standard 120V AC household power), a neutral input terminal 110, and a ground terminal 112 connectable to ground potential. An input AC power signal is received by the ballast 104 from the AC power supply via the high voltage input terminal 108. The ballast 104 includes an electromagnetic interference (EMI) filter and a rectifier (e.g., full-wave rectifier) 114, which are illustrated together in FIG. 1. The EMI filter portion of the EMI filter and rectifier 114 prevents noise that may be generated by the ballast 104 from being transmitted back to the AC power supply. The rectifier portion of the EMI filter and rectifier 114 converts AC voltage received from the AC power supply to a rectified voltage. The rectifier portion includes a first output terminal connected to a DC bus 116 and a second output terminal connected to a ground potential at ground connection point 118. Thus, the EMI filter and rectifier 114 outputs a rectified voltage ($V_{Rectified}$) on the DC bus 116.

A power factor correction circuit 120, which may be, and in some embodiments is, a boost converter, is connected to the first and second output terminals of the EMI filter and rectifier 114. The power factor correction circuit 120 receives the rectified voltage ($V_{Rectified}$) and produces a high voltage ($V_{Boost}$) on a high DC voltage bus ("high DC bus") 122. An energy storage capacitor C14 is connected across the output of the power factor correction circuit 120. An inverter circuit 126 has an input connected to the power factor correction circuit 120 for receiving the high voltage ($V_{Boost}$) from the power factor correction circuit 120. The inverter circuit 126 is configured to convert the high voltage ($V_{Boost}$) from the power factor correction circuit 120 to an oscillating power signal for supplying to the plurality of lamps 106A, 106B. In some embodiments, the inverter circuit 126 includes a first switching component and a second switching component (see FIG. 2). The switching components complementarily operate between a non-conductive state and a conductive state in order to produce the oscillating power signal. A resonant tank circuit 130 is connected to the inverter circuit 126. The resonant tank circuit 130 tunes the oscillating power signal which is then provided to the plurality of lamps 106A, 106B. In FIG. 1, a capacitor $C_{Res}$ and an inductor $L_{RES-A}$ are connected together and form the resonant tank circuit 130. A direct current (DC) blocking capacitor 132 is also connected in series with the plurality of lamps 106A, 106B for blocking DC current from flowing into the plurality of lamps 106A, 106B.

In some embodiments, the ballast 104 includes a pre-heat circuit for providing power to the lamp filaments (represented by resistors R4, R5, R6, and R7) of the lamp set 106A, 106B to heat the lamp filaments (R4, R5, R6, and R7) to a predefined temperature needed to ignite the lamp filaments (R4, R5, R6, and R7). In FIG. 1, inductors $L_{RES-B}$, $L_{RES-D}$, and $L_{RES-C}$ along with LC filters (capacitor C1 and inductor L2, capacitor C2 and inductor L4, and capacitor C3 and inductor L5) form the pre-heat circuit. The inductor $L_{RES-A}$ of the resonant tank circuit 130 and the inductors $L_{RES-B}$, $L_{RES-D}$, and $L_{RES-C}$ are each windings of a transformer, and are wound on the same core.

The lamp system 100 includes a controller 134 for controlling components of the lamp system 100. In some embodiments, the lamp system 100 also includes a power supply (VCC) 136 for powering components of the lamp system 100, such as the controller 134 (connection not shown) and the current control circuit 140 described below. In FIG. 1, the controller 134 includes one or more output terminals that connect the controller 134 to the power factor correction circuit 120, and the controller 134 generates one or more output signals that are provided to the power factor correction circuit 120 via the output terminals in order to control the power factor correction circuit 120. Similarly, the controller 134 includes and one or more output terminals that connect the controller 134 to the inverter circuit 126, and the controller 134 generates on or more output signals that are provided to the inverter circuit 126 in order to control the inverter circuit 126. For example, as described below, in response to an occurrence of arcing in the lamp system 100, the controller 134 generates a shutdown output signal that is provided to the inverter circuit 126 in order to disable the inverter circuit 126 from providing the power signal used to energize the plurality of lamps 106A, 106B.

As described above, the inverter circuit 126 generates an oscillating power signal which is used to provide lamp current to energize the plurality of lamps 106A, 106B. As generally known, the oscillating power signal has a frequency, and the amount of lamp current provided to the plurality of lamps 106A, 106B is a function of the frequency of the power signal. A resistance circuit, comprising a resistor RFRUN1, is connected to the inverter circuit 126. The resistance circuit has a resistance that defines the frequency of the oscillating power signal generated by the inverter circuit 126. As such, the lamp current provided to the lamp set 106A, 106B is also a function of the resistance of the resistance circuit (i.e., the resistor RFRUN1).

The lamp system 100 includes a current control circuit 140 connected to the resistance circuit for adjusting the resistance of the resistance circuit as a function of the number of lamps in the lamp set 106A, 106B that are connected to the ballast 104. For example, the current control circuit 140 may decrease the resistance of the resistive circuit to increase the frequency of the oscillating power signal, and in turn, decrease the lamp current. On the other hand, the current control circuit 140 may increase the resistance of the resistive circuit to decrease the frequency of the oscillating power signal, and in turn, increase the lamp current. As such, for a ballast 104 configured to energize a lamp set having a maximum number of lamps, the current control circuit 140 allows the current provided to the lamp set to be reduced when less than the maximum number of lamps are connected to the ballast 104. Thus, the ballast 104 is configured to adjust the current provided to the lamp set 106A, 106B in order to achieve an ideal and efficient operation for the particular number of lamps being energized. For example, in FIG. 1, the current control circuit 140 adjusts the resistance of resistance circuit by selectively connecting an additional resistive component to the inverter circuit 126 when one of the lamps 106A, 106B in the lamp set 106A, 106B is unconnected to the ballast 104.

Figure 2:
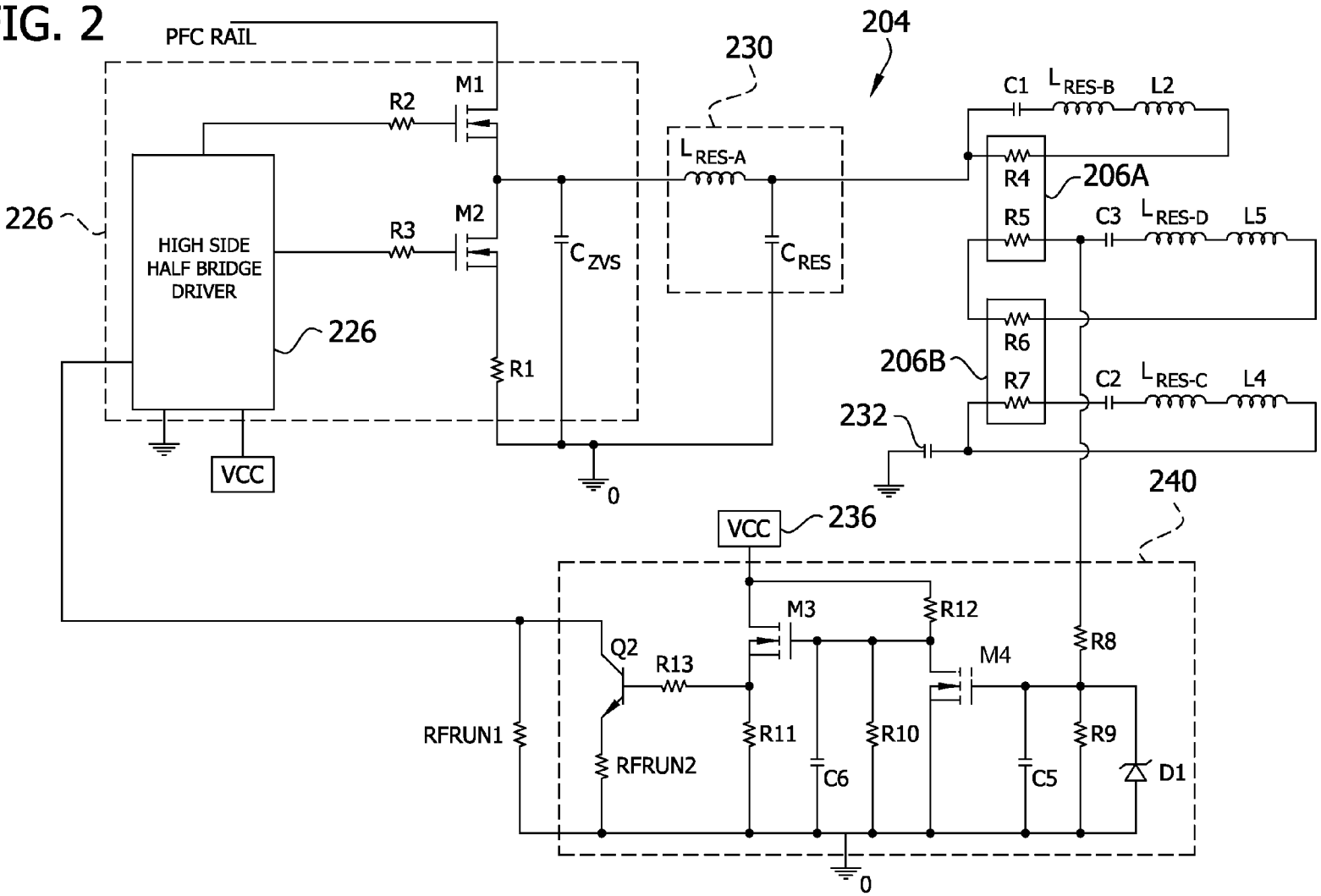
FIG. 2 illustrates a schematic diagram of a current control circuit of the lamp system of FIG. 1 according to embodiments disclosed herein.

FIG. 2 illustrates a current control circuit 240 configured to adjust the lamp current provided to a lamp set 206A, 206B based on the number of lamps connected to a ballast 204 (illustrated in part). In FIG. 2, the current control circuit 240 is designed for use in a ballast 204 configured for energizing a lamp set having a maximum of two lamps. A resistor, RFRUN1, is connected to the inverter circuit 226 to define the frequency of the oscillating power signal and thus the amount of lamp current provided to the lamp set 206A, 206B. When both lamps 206A and 206B are connected to the ballast 204, RFRUN1 is the only resistive component connected to the inverter circuit 226 for defining the frequency of the oscillating power signal. Thus, the current control circuit 240 prohibits additional resistive components from being connected to the inverter circuit 226 to define the frequency of the oscillating power signal. When only one lamp, 206A or 206B, is connected to the ballast 204, the current control circuit 240 connects an additional resistive component, RFRUN2 to the inverter circuit 226 in order to decrease the effective resistance connected to the inverter circuit 226 used to define the frequency of the oscillating power signal. The decrease in resistance results in an increase in the frequency of the oscillating power signal, and thus a decrease in the lamp current provided to the lamps.

In the partially illustrated ballast 204, the inverter circuit 226 includes a high side half bridge driver for driving the complementary switching components, M1 and M2 (shown with gate resistors R2 and R3, and a current sense resistor R1 as generally known in the art). The inverter circuit 226 is adapted for connecting, via a resonant tank circuit 230, to the lamp set 206A, 206B comprising a maximum of two series-connected lamps, a first lamp 206A and a second lamp 206B. The first lamp 206A has a first filament represented by a resistor R4, and a second filament represented by a resistor R5. The second lamp 206B has a first filament represented by a resistor R6, and a second filament represented by a resistor R7. When both lamps 206A and 206B are connected to the ballast 204, the second filament R5 of the first lamp 206A is connected to the first filament R6 of the second lamp 206B so that the first lamp 206A is connected in series with the second lamp 206B.

The current control circuit 240 is adapted for connecting to the lamp set 206A, 206B in order to detect the number of lamps connected to the ballast 204. In FIG. 2, the current control circuit 240 is connected between the second filament R5 of the first lamp 206A and to the capacitor C3 of the pre-heat circuit for pre-heating the second filament R5 of the first lamp 206A and the first filament R6 of the second lamp 206B. The current control circuit 240 is also adapted for connecting to the inverter circuit 226 and to the resistor RFRUN1 in order to selectively connect additional resistance to the inverter circuit 226 when a lamp of the lamp set 206A, 206B is unconnected/disconnected. The current control circuit 240 includes an additional resistor RFRUN2 and a switching circuit (e.g., a switch Q2) for operating in a first state that connects the additional resistor RFRUN2 to the inverter circuit 226 when only one lamp, 206A or 206B, is connected to the ballast 204, and for operating in a second state that prohibits the additional resistor RFRUN2 from being connected to the inverter circuit 226 when both lamps 206A and 206B are connected to the ballast 204.

The current control circuit 240 includes first switch M4, a second switch M3, and a third switch Q2. In some embodiments, the first switch M4 and the second switch M3 are metal-oxide-semiconductor field-effect transistors (MOSFETs), each having a drain terminal, a gate terminal, and a source terminal. The third switch Q2 is a bipolar junction transistor (BJT) having a collector terminal, a base terminal, and an emitter terminal. The gate terminal of the first switch M4 is connected between the second filament R5 of the first lamp 206A and to the capacitor C3 of the pre-heat circuit. A filter capacitor C5 and a clamping diode D1 are connected in parallel between the gate terminal of the first switch M4 and ground potential. Resistors R8 and R9 form a voltage divider connected between the gate terminal of the first switch M4 and the lamp set 206A, 206B. The drain terminal of the first switch M4 is connected to the gate terminal of the second switch M3. The drain terminals of the first and second switches, M4 and M3, are connected to a voltage source (VCC) such as the one discussed above in regard to FIG. 1 that is used to provide voltage to other components inside the ballast. Resistors R10, R11, and R12 form a voltage divider between the switches, M4 and M3, and the voltage source VCC. A filtering capacitor C6 is connected between the gate terminal of the second switch M3 and ground potential. The source terminal of the second switch M3 is connected to the base terminal of the third switch Q2 via a biasing resistor R13. The emitter terminal of the third switch Q2 is connected to ground potential via the resistor RFRUN2, and the collector terminal of the third switch Q2 is connected to the resistor RFFUN1.

In operation, when two lamps, 206A and 206B, are connected to the ballast 204, there is a threshold voltage at the second filament R5 of the first lamp 206A, and thus a threshold voltage at the gate terminal of the first switch M4. This threshold voltage causes the first switch M4 to operate in an ON (i.e., closed) state. With the first switch M4 is operating in the ON state, the gate terminal for the second switch M3 is pulled to ground potential causing the second switch M3 to operate in an OFF (i.e., open) state. The second switch M3 controls the third switch Q2 so that they operate together. As such, the operation of the second switch M3 in the OFF state causes the third switch Q2 to operate in the OFF (i.e., open) state. When the third switch Q2 operates in the OFF state, it does not conduct current and acts as an open circuit, and thus prohibits resistor RFRUN2 from being connected to the inverter circuit 226 and the resistor RFRUN1. Accordingly, RFRUN1 is the only resistive component connected to the inverter circuit 226 for defining the frequency of the power signal generated by inverter circuit 226, and a first lamp current is provided to the lamps 206A and 206B.

When only one lamp, 206A or 206B, is connected to the ballast 204, there is not a threshold voltage (e.g., substantially no voltage) at the second filament R5 of the first lamp 206A, and thereby at the gate terminal of the first switch M4. Since the threshold voltage does not exist at the gate terminal of the first switch M4, the first switch M4 operates in an OFF (i.e., open) state. When the first switch M4 operates in the OFF state, the voltage at the gate terminal of the second switch M3 is a greater than a threshold voltage for the second switch M3 causing the switch M3 to operate in an ON (i.e., closed) state. When the second switch M3 operates in the ON state, it supplies current to the base terminal of the third switch Q2 causing the third switch to operate in an ON (i.e., closed) state. When the third switch operates in the ON state, it connects the resistor RFRUN2 to the inverter circuit 226 so that it is in parallel with resistor RFRUN2. As such, the resistance circuit connected to the inverter circuit 226 for defining the frequency of the power signal generated by the inverter circuit is comprised of resistors RFRUN1 and RFRUN2, and a second lamp current is provided to the lamp 206A or 206B that is connected to the ballast 204. The second lamp current is less than the first lamp current provided when both lamps are connected to the ballast because the effective resistance (RFRUN1 in parallel with RFRUN2) is therefore less than when both lamps 206A and 206B were connected to the ballast 204 and the effective resistance of the resistance circuit consisted only of resistor RFRUN1.

Although the ballast 204 is configured for operating a maximum of two lamps, it should be noted that embodiments contemplate a current control circuit for use in a ballast configured for operating a greater maximum number of lamps.

Unless otherwise stated, use of the word "substantially" may be construed to include a precise relationship, condition, arrangement, orientation, and/or other characteristic, and deviations thereof as understood by one of ordinary skill in the art, to the extent that such deviations do not materially affect the disclosed methods and systems.

Throughout the entirety of the present disclosure, use of the articles "a" and/or "an" and/or "the" to modify a noun may be understood to be used for convenience and to include one, or more than one, of the modified noun, unless otherwise specifically stated. The terms "comprising", "including" and "having" are intended to be inclusive and mean that there may be additional elements other than the listed elements.

Elements, components, modules, and/or parts thereof that are described and/or otherwise portrayed through the figures to communicate with, be associated with, and/or be based on, something else, may be understood to so communicate, be associated with, and or be based on in a direct and/or indirect manner, unless otherwise stipulated herein.

Although the methods and systems have been described relative to a specific embodiment thereof, they are not so limited. Obviously many modifications and variations may become apparent in light of the above teachings. Many additional changes in the details, materials, and arrangement of parts, herein described and illustrated, may be made by those skilled in the art.

What is claimed is:

1. A ballast comprising:

an inverter circuit configured to generate an oscillating power signal, wherein the oscillating power signal has a frequency;

a resonant tank circuit electrically connected to the inverter circuit and configured to receive the oscillating power signal and therefrom to provide a lamp current to a set of lamps connected to the ballast;

a resistance circuit connected to the inverter circuit, the resistance circuit having a resistance that defines the frequency of the oscillating power signal generated by the inverter circuit; and a current control circuit connected to the resistance circuit and configured to adjust the resistance of the resistance circuit as a function of a number of lamps that are connected to the ballast.

2. The ballast of claim 1, wherein the current control circuit is configured to decrease the resistance of the resistance circuit when the number of lamps that are connected to the ballast is decreased.

3. The ballast of claim 1, wherein the resistance circuit includes a first resistive component that is connected to the inverter circuit, and wherein the current control circuit is configured to selectively connect and disconnect a second resistive component to the inverter circuit as a function of the number of lamps that are connected to the ballast.

4. The ballast of claim 1, wherein the resistance circuit includes a first resistive component that is connected to the inverter circuit, and wherein the current control circuit is configured to connect a second resistive component to the inverter circuit in parallel with the first resistive component when the number of lamps that are connected to the ballast is decreased.

5. The ballast of claim 1, wherein the inverter circuit comprises a high side half bridge driver.

6. The ballast of claim 5, wherein the resistance circuit includes a first resistive component that is connected to the high side half bridge driver.

7. The ballast of claim 6, further comprising a second resistive component, wherein the current control circuit comprises a switching circuit that is connected to the second resistive component to selectively connect the second resistive component in parallel with the first resistive component.

8. The ballast of claim 1, wherein the current control circuit is configured to adjust the resistance of the resistance circuit so that the lamp current provided to the lamp set is decreased when the number of lamps that are connected to the ballast is decreased.

9. The ballast of claim 1, further comprising:

a rectifier configured to receive an alternating current (AC) voltage signal and to produce a rectified voltage signal therefrom; and a power factor correction circuit electrically connected to the rectifier and configured to receive the rectified voltage signal and to provide a corrected voltage signal, wherein the inverter circuit is electrically connected to the power factor correction circuit to receive the corrected voltage signal and to generate the oscillating power signal therefrom.

10. A ballast configured to connect to and energize a set of up to a maximum number of lamps, the ballast comprising:

a rectifier configured to receive an alternating current (AC) voltage signal and to produce a rectified voltage signal therefrom;

a power factor correction circuit electrically connected to the rectifier and configured to receive the rectified voltage signal and to provide a corrected voltage signal;

an inverter circuit electrically connected to the power factor correction circuit and configured to receive the corrected voltage signal and to generate an oscillating power signal therefrom, wherein the oscillating power signal has a frequency;

a resonant tank circuit electrically connected to the inverter circuit and configured to receive the oscillating power signal and therefrom provide a lamp current to a set of lamps;

a resistance circuit connected to the inverter circuit, the resistance circuit having a resistance that defines the frequency of the oscillating power signal generated by the inverter circuit, the resistance circuit comprising a first resistive component connected to the inverter circuit and a second resistive component selectively connected to the inverter circuit so that the second resistive component is in parallel with the first resistive component; and a switching circuit configured to connect the second resistive component to the inverter circuit so that it is in parallel with the first resistive component only when a number of lamps in the set of lamps that is less than the maximum number of lamps is connected to the ballast.

11. The ballast of claim 10, wherein the maximum number of lamps is two lamps connected together in series.

12. The ballast of claim 10, wherein the inverter circuit includes a high side half bridge driver, and the first resistive component is connected to the high side half bridge driver.

13. The ballast of claim 10, wherein the switching circuit comprises a first switch, a second switch, and a third switch, wherein the first switch is adapted to connect to the set of lamps to detect a threshold voltage indicative of a presence of a lamp, wherein the second switch is connected to the first switch, and wherein the third switch is connected to the second switch and to the second resistive component and the first resistive component.

14. The ballast of claim 13, wherein the first switch is configured to operate in an ON state when the threshold voltage is detected and to operate in an OFF state when the threshold voltage is not detected.

15. The ballast of claim 13, wherein the second switch is configured to operate in an OFF state when the first switch operates in an ON state, and wherein the second switch is configured to operate in an ON state when the first switch operates in an OFF state.

16. The ballast of claim 13, wherein the third switch is configured to operate in an OFF state when the second switch operates in an OFF state, and wherein the third switch is configured to operate in an ON state when the second switch operates in an ON state.

17. A ballast comprising:

a rectifier configured to receive an alternating current (AC) voltage signal and to produce a rectified voltage signal therefrom;

a power factor correction circuit electrically connected to the rectifier and configured to receive the rectified voltage signal and to provide a corrected voltage signal;

an inverter circuit electrically connected to the power factor correction circuit and configured to receive the corrected voltage signal and to generate an oscillating power signal therefrom, wherein the oscillating power signal has a frequency;

a resonant tank circuit electrically connected to the inverter circuit and configured to receive the oscillating power signal and therefrom provide a lamp current to a set of one or more lamps;

a resistance circuit connected to the inverter circuit, the resistance circuit having a resistance that defines the frequency of the oscillating power signal generated by the inverter circuit, the resistance circuit comprising a first resistive component connected to the inverter circuit and a second resistive component selectively connected to the first resistive component; and a switching circuit configured to operate in a first state that connects the second resistive component to the first resistive component when only one lamp is connected to the ballast and to operate in a second state that prohibits a connection between the second resistive component and the first resistive component when more than one lamp is connected to the ballast.

18. The ballast of claim 17, wherein the second resistive component is selectively connected in parallel with the first resistive component.

19. The ballast of claim 17, wherein the inverter circuit includes a high side half bridge driver, and the first resistive component is connected to the high side half bridge driver.

20. The ballast of claim 17, wherein the switching circuit comprises a first switch, a second switch, and a third switch, wherein the first switch is adapted to connect to the set of lamps to detect a threshold voltage indicative of a presence of a lamp, wherein the second switch is connected to the first switch, and wherein the third switch is connected to the second switch and to the second resistive component and the first resistive component.

* * * * *